United States Patent [19]

Schrader

[11] 4,216,729

[45] Aug. 12, 1980

[54] DECK CHANNEL FOR STORAGE RACK BEAM

[75] Inventor: Donald E. Schrader, Nashville, Tenn.

[73] Assignee: Nashville Wire Products Manufacturing Co., Inc., Nashville, Tenn.

[21] Appl. No.: 10,242

[22] Filed: Feb. 8, 1979

[51] Int. Cl.[3] ..... A47B 3/06; A47F 5/14

[52] U.S. Cl. ..... 108/159; 211/182; 211/191

[58] Field of Search ..... 211/191, 192, 186, 182; 108/159, 52.1, 110; 52/289, 702, 815, 818, 656, 263, 738; 5/191, 236

[56] References Cited

U.S. PATENT DOCUMENTS

| | | | |
|---|---|---|---|
| 510,562 | 12/1893 | Breslin | 108/110 |
| 2,309,212 | 1/1943 | Reeves | 211/153 |
| 3,194,408 | 7/1965 | Kimpton | 211/191 |
| 3,285,428 | 11/1966 | Scheck | 211/182 X |
| 3,981,249 | 9/1976 | Herrmann | 108/52.1 |
| 3,986,462 | 10/1976 | Heft | 211/153 X |
| 4,078,664 | 3/1978 | McConnell | 108/159 X |
| 4,101,233 | 7/1978 | McConnel | 108/159 X |

FOREIGN PATENT DOCUMENTS

| | | | |
|---|---|---|---|
| 921869 | 2/1973 | Canada | 211/91 |

*Primary Examiner*—James T. McCall

*Attorney, Agent, or Firm*—Harrington A. Lackey

[57] ABSTRACT

A support member for a deck member, such as a wire shelf, including an elongated channel having opposite end portions which are preferably die-formed to include side wall portions of lesser depth than the side walls of the channel and a web portion having a vertically projecting central flange member and bearing surfaces above the plane of the web of the main channel member, the bearing surfaces being adapted to rest upon the ledge of a transverse support beam, so that the support member spans a pair of support beams upon which the opposite end portions of the channel are supported.

8 Claims, 9 Drawing Figures

PRIOR ART

DECK CHANNEL FOR STORAGE RACK BEAM

BACKGROUND OF THE INVENTION

This invention relates to storage racks, and more particularly to deck channel supports for mounting on rack beams.

In certain types of storage racks in material handling and storage systems, a storage bay may consist of front and rear transverse beams supported upon upright posts and a plurality of elongated support members spanning and resting upon the top ledges of the respective front and rear beams. Decks, shelves, or pallets may be supported upon the longitudinal support members.

One specific form of a deck member may be a wire shelf which is welded to a plurality of elongated support channels, the opposite end portions of which rest upon the front and rear beams. Where the front and rear beams are rack offset beams having depressed steps or recesses, the opposite end portions of the support channels are adapted to bear upon the steps. However, if the steps are too shallow and the end portions are of the same uniform depth as the rest of the channel, then the deck member will be elevated too high above the offset beam. If the depth of the support channels is reduced to render the deck member substantially level with the offset beam, the support channels will be commensurately weakened to provide inadequate strength for the deck members or shelves, particularly where they are supporting quite heavy loads.

In order to overcome the above problem, the bottom portions of the end portions of the channels adapted to rest upon the steps have been cut out so that the end portions consist solely of a pair of longitudinally extending channel side walls, of lesser height than the side walls of the main channel, and without any connecting web portions. Although such construction maintains the depth and strength of the main body of the channel, nevertheless the undercutting weakens the end portions, causing them to buckle, collapse and otherwise fail when resting upon the steps of the offset beams, under heavy loads.

SUMMARY OF THE INVENTION

It is therefore an object of this invention to provide an elongated channel support member in which the end portions have been reduced in height, but in which the side walls of each end portion is connected by a web portion.

The end portion of each support channel made in accordance with this invention is preferably die-formed by forcing a die of predetermined shape downward against the end portion of the channel member in inverted position, so that the web portion is forced downward, as the side walls are cut. The excess web material is turned downward to form a downward projecting, looped, double-wall center flange. Thus, a very strong end portion is formed by utilizing the existing material in the end portion of the channel. The side wall portions of each end portion are not only continually connected to each other by the inturned web portion, but also an additional center flange is provided for strength and stability, having a double-wall thickness.

A pair of arch-shaped or convex bearing surfaces are formed in the web portion on opposite sides of the double-wall center flange and integrally connecting the center flange to the external side wall portions of each end portion of the channel member.

The method of die-forming the end portions as described above is quicker and more economical than the prior art method of removing the web and the parts of the side walls of the end portions, as previously described.

The top edges of the side walls of the support channel are welded to the cross wires of the wire shelf, in a conventional manner, for supporting the shelf upon the transverse offset beams.

DESCRIPTION OF THE PREFERRED EMBODIMENTS

Figures 1, 2, 3, 4, 5, 6, 7, 8, 9:
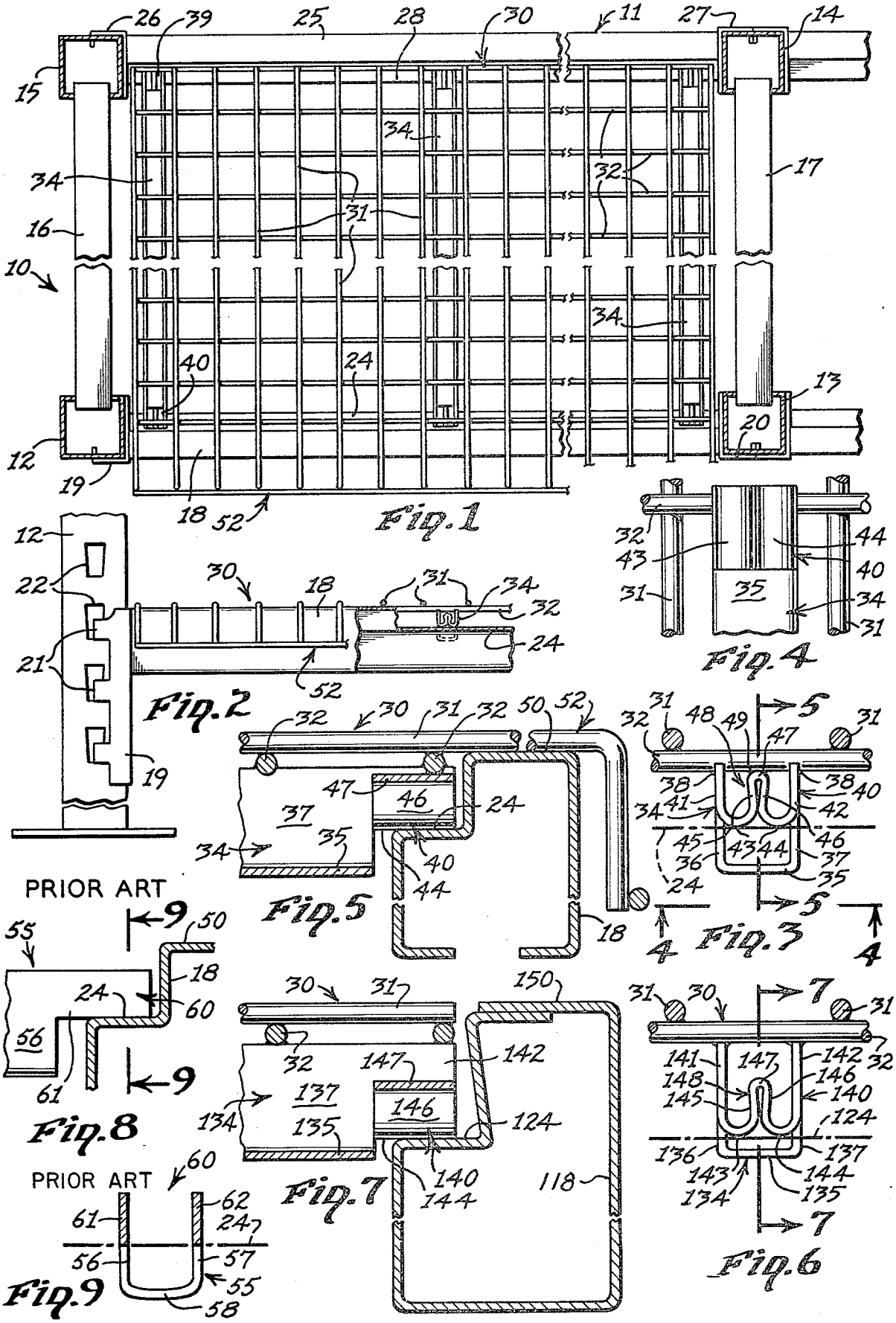
Fig. 9 PRIOR ART
FIG. 1 is a top plan view of a wire shelf affixed to a plurality of the channel support members, made in accordance with this invention, portions of which are broken away, and mounted upon a pair of offset rack beams in a storage rack bay.
FIG. 2 is a fragmentary front elevation of a portion of the storage rack bay, wire shelf and support channel disclosed in FIG. 1, with portions broken away.
FIG. 3 is an end elevation of the channel support member made in accordance with this invention affixed to the wire shelf, shown fragmentarily.
FIG. 4 is a fragmentary bottom plan view taken along the line 4—4 of FIG. 3.
FIG. 5 is a fragmentary sectional elevation taken along the line 5—5 of FIG. 3, of one end portion of the channel support member resting upon an offset beam.
FIG. 6 is a view similar to FIG. 3 of a modified form of channel support member.
FIG. 7 is a fragmentary section, taken along the line 7—7 of FIG. 6, similar to FIG. 5.
FIG. 8 is a fragmentary sectional elevation of one end portion of a prior art support channel resting upon the step of an offset beam, shown fragmentarily.
FIG. 9 is a section taken along the line 9—9 of FIG. 8, with the offset beam step shown in phantom.

Referring now to the drawings in more detail, FIG. 1 discloses a storage rack 10, including a bay 11 having four upright posts 12, 13, 14 and 15, a side beam 16 connecting the posts 12 and 15 and an opposite side beam 17 connecting the posts 13 and 14. A front offset beam 18 is adjustably supported between the front posts 12 and 13 by means of brackets 19 and 20 of conventional construction. The bracket 19 is provided with a plurality of vertically spaced hooks or teeth 21 for adjustably engaging vertically spaced apertures 22 in post 12. The bracket 20 is of identical, but mirror-image, construction as the bracket 19. The front offset beam 18 is provided with an offset ledge, depressed seat or step 24.

A rear offset beam 25 is connected at its opposite ends by brackets 26 and 27 to the rear posts 15 and 14, respectively. Each bracket 26 and 27 may be identical to brackets 19 and 20. The rear offset beam 25 is provided with a depressed seat or step 28 opposing the rear step 24 of the front beam 18. In other words, the step 28 is on the front side of the rear beam 25, while the step 24 is on the rear side of the front offset beam 18.

Adapted to be supported upon the front offset beam 18 and rear offset beam 25 in a bay 11 is a deck member in the form of a wire shelf 30 having a plurality of longitudinally, or front-to-rear, extending wire rods 31 parallel and uniformly spaced and rigidly secured to underlying, elongated, transversely parallel, and uniformly spaced wire rods 32. Fixed to, such as by welding, the bottom surfaces of the transverse wire rods 32 are a plurality of transversely spaced channel support members 34, made in accordance with this invention.

Each elongated channel support member 34 has a main channel portion including a web 35 integrally joining the bottom edge portions of a pair of vertically disposed side walls 36 and 37. It is the top edges of the side walls 36 and 37 which are bonded by the welds 38 to the bottom surface of the transverse rods 32.

The opposite end portions 39 and 40 of each channel support member 34 are identical in construction, except extending in opposite directions.

The front end portion 40 includes a pair of side wall portions 41 and 42 of lesser height than the side walls 36 and 37 of the main channel of the support member 34. The side wall portions 41 and 42 are longitudinal extensions of the main side walls 36 and 37, respectively. The top edges of the side wall portions 41 and 42 may also be secured to the bottom surface of a transverse wire rod 32 by welds 38.

The lower edge portions of the side wall portions 41 and 42 are connected by a web portion including a pair of downwardly convex or arched bearing surfaces 43 and 44, respectively. The inner portions of the bearing surfaces project upwardly in a pair of flange walls 45 and 46 and join each other at their upper edge portions in a looped portion 47, to form an upward projecting and longitudinally extending flange member 48.

Each of the end portions 39 and 40 is preferably constructed by die-forming the respective end portions of the channel support member 34 so that the web 35 and the adjoining lower portions of the side wall 36 and 37 are cut transversely by the die, and the web part is forced upward, turning the excess metal in the middle of the web upward into the looped portion 47 to form the looped flange member 48 and the downward convex bearing surfaces 43 and 44, as best disclosed in FIG. 3.

It will be noted in FIG. 3, that the flange member 48 extends upward as far as it will go, because the looped edge portion 47 abuts against the bottom surface of the wire rod 32, and is preferably secured to the wire rod 32 by a weld 49. Where the flange member 48 extends as far upward as it will go, the overall depth of the end portion 40 is at its lower limit, and designed to seat upon the front step 24 of a shallow offset in an offset beam 18. The step 24 is typically about $\frac{7}{8}$ inch below the surface of the top wall or top ledge 50 of the beam 18. It will be noted in FIG. 5, that the wire shelf 30 is slightly elevated above the top ledge 50 by the thickness of the top wire rod 31, which projects forward to form a front apron 52 in a "waterfall" type wire shelf 30.

The channel beam 134 disclosed in FIGS. 6 and 7 is identical to the channel beam 34 disclosed in FIGS. 1–5, having a web 135 and side walls 136 and 137 of the same shape and size as the corresponding web 35 and side walls 36 and 37, for supporting the wire shelf 30. However, the end portion 140 is of a greater depth than the end portion 40, in order to seat upon the front step 124 of an offset beam 118 having a deeper offset from the top ledge 150. A typical offset beam 118 would have a vertical offset of $1\frac{5}{8}$ inches.

The end portion 140 has the same extended side wall portions 141 and 142, arch bearing surfaces 143 and 144, flange walls 145 and 146, and looped portion 147 of a flange member 148, as the end portion 40, except for the differences in height or depth. The side wall portions 141 and 142 are of a corresponding greater height than the side wall portions 41 and 42 in order for the corresponding arched bearing surfaces 143 and 144 to seat upon the top step 124 and so that the top of the wire shelf 30 will be substantially flush with the top ledge 150.

Because the end portion 140 is die-formed from a channel portion having the same dimensions and the same shape and including the same amount of material as the support member 34, the central flange member 148 is of lesser height than the central flange member 48 of the end portion 40.

Regardless of the height of the end portion 40 or 140, there is a balance in the strength between the various elements of the end portions. Although the side wall portions 41 and 42 are relatively shallow or short in height, nevertheless the side wall portions 141 and 142 are of greater depth to afford greater strength. To offset these differences in strength, the end portion 40 has a substantially stronger central flange member 48 because of its greater height and because it is welded to the transverse wire rod 32. To the contrary, the central flange portion 148 is of lesser height and therefore does not possess the strength of the central flange portion 48. Even for end portions which would have heights intermediate the heights of the end portions 40 and 140, the strength balance would be substantially maintained because as the side wall portions 41 and 42 gradually increase in height, the central flange member 48 would correspondingly decrease in height. The end portion 40 would still have the same amount of material, but bent and pressed to different heights.

FIGS. 8 and 9 illustrate a prior art channel support member 55 having side walls 56 and 57 and a web 58. The end portion 60 on the prior art channel support member 5 is formed merely by relieving the entire bottom portion of the web and the lower portions of the extended side walls to leave only a pair of extended side walls 61 and 62 of the desired height to seat upon the step 24 of an offset beam 18. The inherent weakness of the prior art end portion 60 is manifest, by virtue of the freely extending side wall portions 61 and 62, which are completely unconnected with each other, except as they extend in cantilever fashion from the side walls 56 and 57 of the main channel body. There is no web connection between the side wall portions 61 and 62 in the prior art end portion 60. In actual load tests, the side wall portions 61 and 62 have easily bent, twisted, or otherwise failed when supporting loads which are typically supported by the wire shelf 30 in a storage rack 11.

Moreover, it is more expensive to form the end portion 60 than it is to form the end portions 40 and 140, since a time-consuming cutting operation is required to relieve the lower portion of the channel beneath the extended side wall portions 61 and 62. On the other hand, a simple, single downstroke of the appropriate die is all that is necessary to form either of the end portions 40 or 140. Channel support members such as 34 and 134 with the end portions 39, 40, and 140, respectively, can be rapidly, as well as economically, produced.

The reason for the formation of the end portions 40, 140 and even 60, is to maintain the greater channel depth of the respective channel support members 34, 134, and 55 to provide adequate strength for supporting the wire shelves 30, when they in turn support the customarily heavy objects normally stored in a storage rack such as 10.

The end portions 40 and 140 also have greater strength because of the double wall configuration of the center flange member 48. The folding in or creasing of the extra material to project upward automatically forms the double walls 45 and 46. The arched configuration of the bearing surfaces 43 and 44 also provide greater strength than a flat configuration.

Moreover, in the entire configuration of an end portion 40, there are no sharp intersection or joints. All of the joints or intersections between the various side wall portions 41 and 42, bearing surfaces 43, 44 and side flange walls 45 and 46 are smooth, uninterrupted and curved.

What is claimed is:

1. In a deck member having a longitudinal dimension adapted to span a pair of longitudinally spaced transverse support beams, each beam having a ledge, a support member comprising:

(a) an elongated channel of predetermined depth including opposed side walls having top edges and a bottom web, and having opposite end portions, (b) each end portion comprising side wall portions constituting longitudinal extensions of said side walls, but of lesser depth than said side walls and having lower edge portions, (c) each end portion further comprising a web portion connecting said lower edge portions and having a bearing surface above said bottom web adapted to bear upon a ledge of a support beam, so that said support member can support the deck member on the transverse support beams, and (d) said web portion comprising an elongated center flange member projecting upward from said bearing surface between said side wall portions.

2. The invention according to claim 1 in which said bearing surface comprises a pair of downward convex bearing surfaces on opposite sides of said center flange member.

3. The invention according to claim 2 in which said side wall portions and said web portion are integrally formed in each of said end portions.

4. The invention according to claim 3 in which each of said end portions is die-formed in a corresponding end of said channel.

5. The invention according to claim 1 in which said center flange member comprises a pair of flange walls connected to said bearing surface and merging in an upper looped edge portion.

6. The invention according to claim 5 in which said bearing surface comprises a pair of downward convex bearing surfaces, each of which joins a flange wall.

7. The invention according to claim 1 in which said elongated channel opens upward so that said side walls terminate in said corresponding top edges, and further comprising a deck member in the form of a wire shelf member having a bottom surface, securing means bonding said top edges of said side walls to said bottom surface of said shelf member.

8. The invention according to claim 1 further comprising a pair of longitudinally spaced transverse support beams, each support beam constituting an elongated offset beam, each of said ledges consisting of a step on each of said offset beams.

* * * * *